US006183212B1

(12) United States Patent
Djordjevic

(10) Patent No.: US 6,183,212 B1
(45) Date of Patent: Feb. 6, 2001

(54) SNAP-IN CONNECTION FOR PUMPING PLUNGER SLIDING SHOES

(75) Inventor: Ilija Djordjevic, East Granby, CT (US)

(73) Assignee: Stanadyne Automotive Corp., Windsor, CT (US)

( * ) Notice: Under 35 U.S.C. 154(b), the term of this patent shall be extended for 0 days.

(21) Appl. No.: 09/339,370

(22) Filed: Jun. 24, 1999

Related U.S. Application Data

(60) Provisional application No. 60/120,554, filed on Feb. 17, 1999.

(51) Int. Cl.[7] ..... F04B 1/04; F02M 7/00

(52) U.S. Cl. ..... 417/273; 417/462; 123/447; 123/450

(58) Field of Search ..... 417/271, 273, 417/349, 364; 123/456, 458, 509, 450, 451, 506, 495

(56) References Cited

U.S. PATENT DOCUMENTS

| | | | | |
|---|---|---|---|---|
| 2,302,864 | | 11/1942 | Huber | 163/174 |
| 2,612,837 | | 10/1952 | Midgette | 103/5 |
| 2,621,607 | | 12/1952 | Trapp | 103/174 |
| 3,295,459 | | 1/1967 | Griffith | 103/161 |
| 4,498,799 | | 2/1985 | Wartelle et al. | 403/140 |
| 5,078,113 | * | 1/1992 | Haag et al. | 123/447 |
| 5,511,959 | * | 4/1996 | Tojo et al. | 418/55 |
| 5,769,611 | * | 6/1998 | Djordjevic | 417/273 |
| 5,848,879 | * | 12/1998 | Hansson | 417/521 |
| 5,947,699 | * | 9/1999 | Cooke | 417/273 |

FOREIGN PATENT DOCUMENTS

| | | | |
|---|---|---|---|
| 26 31 739 | 1/1978 | (DE) | F04B/1/04 |
| 34 20 520 | 5/1985 | (DE) | F04B/1/04 |
| 195 03 621 | 8/1996 | (DE) | F04B/1/04 |
| 197 12 838 | 1/1998 | (DE) | F01B/1/00 |
| 2 174 365 | 12/1973 | (FR) . | |

* cited by examiner

*Primary Examiner*—Teresa Walberg
*Assistant Examiner*—Jeffrey Pwu
(74) *Attorney, Agent, or Firm*—Alix, Yale & Ristas, LLP

(57) ABSTRACT

A fuel supply pump having a plurality of radially disposed plunger sleeves each containing a pumping plunger with a driven end reciprocally movable within the plunger sleeve between a pumping position and a filling position. The fuel supply pump includes a rotatable drive member and a plurality of sliding shoes. Each shoe has a first face adjacent a respective plunger driven end and a second face adjacent the drive member. In one variation, each shoe first face includes a socket which the plunger driven end snaps into and is captured by, creating a sliding shoe assembly. A case couples all of the sliding shoe assemblies. In another variation, the cage includes apertures which the plunger driven end snaps through, thereby capturing the plunger. The plunger driven end engages a seat included on the sliding shoe first face. Rotation of the drive member moves each shoe, and thereby, each plunger toward the pumping position. As one plunger is actuated toward the pumping position by the eccentric member at least one plunger is retracted to the filling position by the coupling of the cage. The coupling of the shoe assemblies and the cage allows for the creation of a controlled gap between the a shoe second face and the drive member for part of the drive member rotation. Also a method of fuel supply pump assembly using sub-assemblies which can be assembled externally to the fuel supply pump body.

31 Claims, 17 Drawing Sheets

SNAP-IN CONNECTION FOR PUMPING PLUNGER SLIDING SHOES

CROSS-REFERENCE TO RELATED APPLICATIONS

This application claims the benefit of the filing date of U.S. patent application Ser. No. 09/031,859, filed Feb. 27, 1998, and U.S. Provisional Application No. 60/120,554, filed Feb. 17, 1999.

BACKGROUND OF THE INVENTION

The present invention relates to a supply pump for fuel injection into an internal combustion engine. More particularly, the invention relates to a supply pump with pumping plungers which are retained by sliding shoes or a cage.

One type of conventional fuel supply pump has plungers which reciprocate radially in corresponding pumping bores. As each plunger moves toward a filling position, fuel is drawn into the pumping bore. As the plunger moves toward a pumping position, fuel at an elevated pressure is discharged from the pumping bore. The plungers may be internally or externally driven. In an internally driven supply pump a rotating drive member periodically actuates the radially inner end of each plunger outwardly. In this type of pump, fuel is discharged from the bore on the radial outward stroke of the plunger and drawn into the bore on the radial inward stroke of the plunger. Thus the filling position is the radially innermost plunger position and the discharge position is the radially outermost plunger position. The converse arrangement is present in an externally driven supply pump, which has pumping plungers actuated at their radially outer end (e.g., by a rotating annular cam) and therefore a radially inwardly discharge stroke and a radially outwardly filling stroke. In either pump type, the rotary motion of the drive member is converted to linear motion of the plungers for movement to the pumping position. Because the plunger is not attached to the eccentric drive or cam, a spring is used to bias the plunger back toward the filling position. In the conventional fuel supply pump, each plunger is biased and returned to its filling position by its own return spring independently of the other plungers.

Conventionally, a sliding shoe is interposed between the plunger and drive member to aid in conversion of the rotary drive member motion to linear plunger motion. The shoes must be maintained in essentially constant contact with both the drive member and the plunger end. This is usually accomplished via an independent spring bias for each shoe and a pivotable connection between the shoe and plunger. Typically, each plunger and its respective shoe is biased by the same spring. The pivotable connection between the plunger and shoe presents problems in manufacture and assembly. Conventionally, it is difficult to find a shoe material with adequate wear resistance yet still ductile enough to allow the shoe to be formed around a plunger end to capture the plunger. It is also difficult to mechanically form the sliding shoe around the plunger captured end while achieving the optimum retentive fit between these components. Finally, assembly of the sliding shoe/plunger sub-assembly into the fuel pump bore is difficult and can only be done manually.

More efficient space utilization, higher pump efficiency and improved sliding surface lubrication can be achieved by eliminating the conventional coil return springs and dynamically connecting all of the sliding shoes or all of the plungers. In particular, a pivotable connection between the plunger and the shoe and desmodromic drive of these reciprocating members by an energizing ring or retainer cage, make spring elimination and the previously mentioned benefits possible.

SUMMARY OF THE INVENTION

An object of the invention is to provide a pivotable connection between a fuel pump plunger and sliding shoe.

Another object of the invention is to provide sliding shoe and plunger components which allow a pivotable connection and are easily manufactured.

A further object of the invention is to create a pivotable connection between a fuel pump plunger and sliding shoe which will operate in cooperation with a desmodromic drive.

Yet another object of the invention is to provide a pivotable connection between the fuel pump plunger and sliding shoe which can be quickly and easily assembled within a fuel pump body.

Still another object of the invention is to provide a method of assembling a fuel pump drive sub-assembly external to the fuel pump body, and installing the drive sub-assembly into a fuel pump.

A first embodiment of the invention concerns the pivotable connection between the fuel pump plunger and the fuel pump sliding shoe. Each sliding shoe has a first face and an opposing second face and each pumping plunger includes a body with a pumping end and an opposing driven end. The sliding shoe first face engages the driven end of the plunger while the second face of the sliding shoe slidingly engages the rotating drive member. The sliding shoes are not directly attached to the drive member, although each plunger is forced toward a pumping position by the action of the rotating member against its respective shoe. Each sliding shoe and its respective pumping plunger can therefore be thought of as a sliding shoe assembly. The driven end of the plunger includes a head, which may be substantially spherically shaped. The head may be connected to the plunger by a neck, having a smaller diameter than either the plunger body or spherical head. The sliding shoe first face includes an internal wall defining a substantially spherical socket with a circular opening. The diameter of the circular opening is smaller than the maximum diameters of either the plunger head or shoe socket. In this manner, as the plunger head is moved toward the sliding shoe socket, the socket opening "flexes" to accommodate the greater diameter of the plunger head. Once the maximum diameter of the plunger head has moved past the socket opening, the opening returns to its original diameter, thereby pivotably trapping the plunger head within the socket of the sliding shoe socket. Thus, the plunger head "snaps" into the sliding shoe socket. Preferably the flexing of the socket opening is within the elastic limit for the material comprising the sliding shoe so that no permanent deformation of the socket or socket opening takes place.

In one preferred variation, the sliding shoes are each connected to a cage so that an essentially fixed spatial relationship is maintained between the shoes. It should be understood that this fixed relationship is maintained even though the sliding shoes and cage are in motion when the supply pump is in use. Thus, as one shoe and its plunger is moved toward its pumping position by the drive member, the cage couples this movement to at least one other shoe, and thereby its plunger, which is moved toward its filling position. In this fashion, the rotary motion of the drive member is converted into the reciprocating linear motion of each plunger without the need for spring biasing of either the plunger or shoes. Although the preferred implementation of the invention uses a cage to desmodromically drive the shoe assemblies, the "snap in" connection of the shoe socket and plunger head may also be advantageously employed in conventional spring biased designs.

In another variation, the sliding shoe socket includes apertures or slots in the wall which increase the flexibility of the wall. This allows the shoe to be manufactured from less resilient materials while still allowing an elastic snap fit with the plunger head; or greater flexibility to be obtained for a given material compared to a non-slotted variation.

In a further variation, the cage includes apertures which have a width less than the diameter of the plunger head. In a fashion analogous to the snap fit of the plunger head into the sliding shoe socket, the cage apertures elastically flex to allow the larger plunger head to pass through, flexing back after passage to thereby pivotably trap the plunger head to the cage. In this variation, the sliding shoe first face includes a partially spherical cavity or seat which engages, but does not necessarily capture, the plunger head. This variation allows the use of higher strength sliding shoe materials which are too brittle to flex and capture the plunger head, while still allowing desmodromic drive of the plungers.

In a different variation, the plunger head has a larger radius adjacent the neck and a smaller radius at the free end. The smaller radius free end allows easy insertion of the plunger head through the cage aperture while the larger radius adjacent the neck creates a shoulder against which the cage abuts. The addition of the large radius shoulder increases the force required to pull the plunger out of the cage aperture.

In a still different variation, the cage may incorporate keyhole apertures with a larger diameter end, or installation window, and a smaller diameter end, or working window. The larger diameter end allows the plunger head to pass through. The smaller diameter end accommodates the plunger neck, with the larger diameter plunger body and head trapping the plunger to the cage. The cage may be rotationally fixed within the pump body to prevent rotation of the cage with respect to the plungers and consequent movement of the plunger into the keyhole aperture large diameter end.

Alternatively, the keyhole aperture may include a narrowed region or plunger stop between the large and small diameter ends. The plunger neck includes a loading groove. The plunger is inserted into the keyhole large diameter end and the plunger neck loading groove moves past the plunger stop, positioning the plunger neck in the small diameter end of the keyhole aperture. During use, the plunger is axially displaced so that the plunger neck aligns with the plunger stop, preventing movement of the plunger from the small diameter end to the large diameter end. It should be noted that these variations are applicable to both internally and externally driven fuel pumps.

In any desmodromic variation, the pivotable capture of the plunger head to the sliding shoe and the fixed relationship of the shoe assemblies defined by their mounting to the cage allows a momentary gap to be created between the drive member and shoe sliding surface when the shoe changes from radially outward to radially inward motion or vice versa. This momentary gap allows fluid to enter the interface between the shoe and eccentric member, reducing friction, torque and wear and thereby increasing load carrying capability of the shoes and drive member. Alternatively, the use of an cage with some "flex" would still maintain the shoe assemblies in a substantially fixed relationship while also allowing a momentary gap to be created between the drive member and shoe sliding surface.

A second embodiment of the invention concerns methods for assembling a high pressure fuel pump incorporating the disclosed pivotable connections. One method comprises assembling a drive sub-assembly external to the pump body. The drive sub-assembly includes a shaft with a drive member eccentrically mounted to the shaft, a plurality of shoes adjacent the drive member and a cage contiguous with each sliding shoe. The cage serves to hold the shoes in position adjacent the drive member. The drive sub-assembly is then installed into the pump body. A plunger is installed into a plunger bore within the pump body with the plunger head snapping into, and being captured by, a sliding shoe socket. In variations where the plunger head is pivotably captured by the cage, the assembly method is generally the same. After installation of a drive sub-assembly into the pump body, the plunger head snaps through, and is trapped by, an aperture in the cage and fits within the sliding shoe seat. Alternatively, each shoe and plunger may be assembled to create a sliding shoe assembly. Each plunger pumping end is then inserted into a plunger bore with the driven end and pivotably connected sliding shoe remaining outside the bore.

BRIEF DESCRIPTION OF THE DRAWINGS

These and other objects and advantages of the invention will be evident to one of ordinary skill in the art from the following detailed description made with reference to the accompanying drawings, in which.

DESCRIPTION OF THE PREFERRED EMBODIMENT

Figure 1:
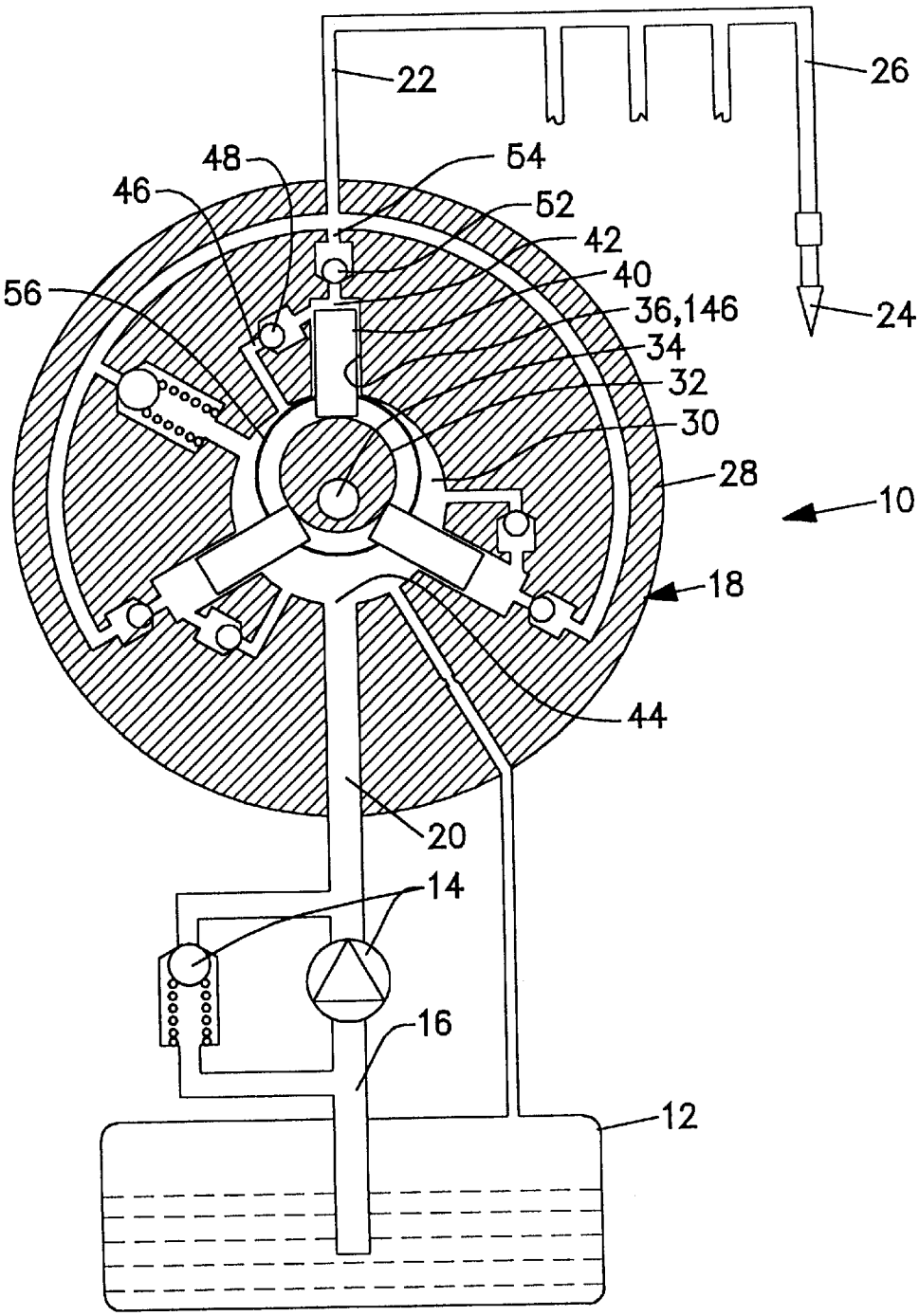
FIG. 1 is a schematic representation of an internally driven-externally pumping fuel supply pump in accordance with an embodiment of the present invention.

FIG. 1 is a schematic of a fuel injection system 10, comprising a fuel tank 12, a low pressure feed pump 14 with associated pressure regulator, for delivering fuel via low pressure fuel line or suction line 16, to the internally driven fuel supply pump 18. The fuel from the feed pump 14 enters supply pump 18 through an intake or feed passage 20, where the fuel pressure is increased. The high pressure fuel is discharged to an external common rail 22 for delivery to a plurality of fuel injectors 24, each of which is fed by a fuel injector branch line 26. Alternatively, but not shown, the pump 18 may discharge directly to the branch lines 26.

The internally driven supply pump 18 is comprised of a pump housing 28 and an internal cavity 30, to which the low pressure fuel is supplied via feed passage 20. An eccentric drive member 32 is rotatable within the cavity 30, around drive shaft 34, for increasing the fuel pressure in the following manner. A plurality of plunger bores 36 or sleeves 146 extend radially from the cavity, typically equi-angularly. The center lines or axes of the plunger bores lie on a plane, shown best in FIG. 3, which will be referred to as the pumping plane. A pumping plunger 40 is situated in a respective bore 36, for reciprocal radial movement therein as a result of the eccentric rotation of the drive member 32. A pumping chamber 42 is formed at the radially outer end of each plunger bore 36. Fuel at feed pressure enters the cavity through a cavity inlet port 44. As this fuel fills the cavity 30, it likewise fills the respective charging passages 46, which are normally closed by the charging check valve 48. In a manner to be described more fully below, the plungers 40 are actuated by means of captured sliding shoes 50 (schematically not shown in FIG. 1), which are forced to follow the eccentric member 32 over at least part of its rotation. It can be appreciated that if each plunger 40 is drawn radially inwardly, the pressure in the pumping chamber 42 will be reduced, thereby opening the charging check valve 48, whereby fuel at the cavity pressure is delivered to the pumping chamber 42. Thereafter, as the plunger 40 is urged radially outwardly by the rotation of the drive member 32, the fuel in the pumping chamber 42 undergoes high pressure, thereby opening the discharge check valve 50 and flowing through the discharge passage 54 into the common rail 22 or branch lines 26. While the fuel supply into and fuel discharge from the pumping chamber are described to provide an overall understanding of the invention, these aspects of a fuel supply pump are not critical to the practice of the invention except as may be later described. Therefore, the invention described herein is capable of combination with nearly any variation of fuel supply and discharge mechanisms.

The cage 56 connects the reciprocating elements (shown schematically in FIG. 1 as only pumping plungers 40) in a fixed or substantially fixed spatial relationship. As the eccentric drive member 32 rotates, it forces some of the plungers 40 radially outward. The radially outward movement of some plungers 40 exerts a dynamic pull or tension against the cage 56. This pull or tension is communicated by the cage 56 to the remaining plungers 40, causing at least some of the remaining plungers to be retracted in a radially inward fashion, following, and limited by, the eccentric member 32.

Figure 2:
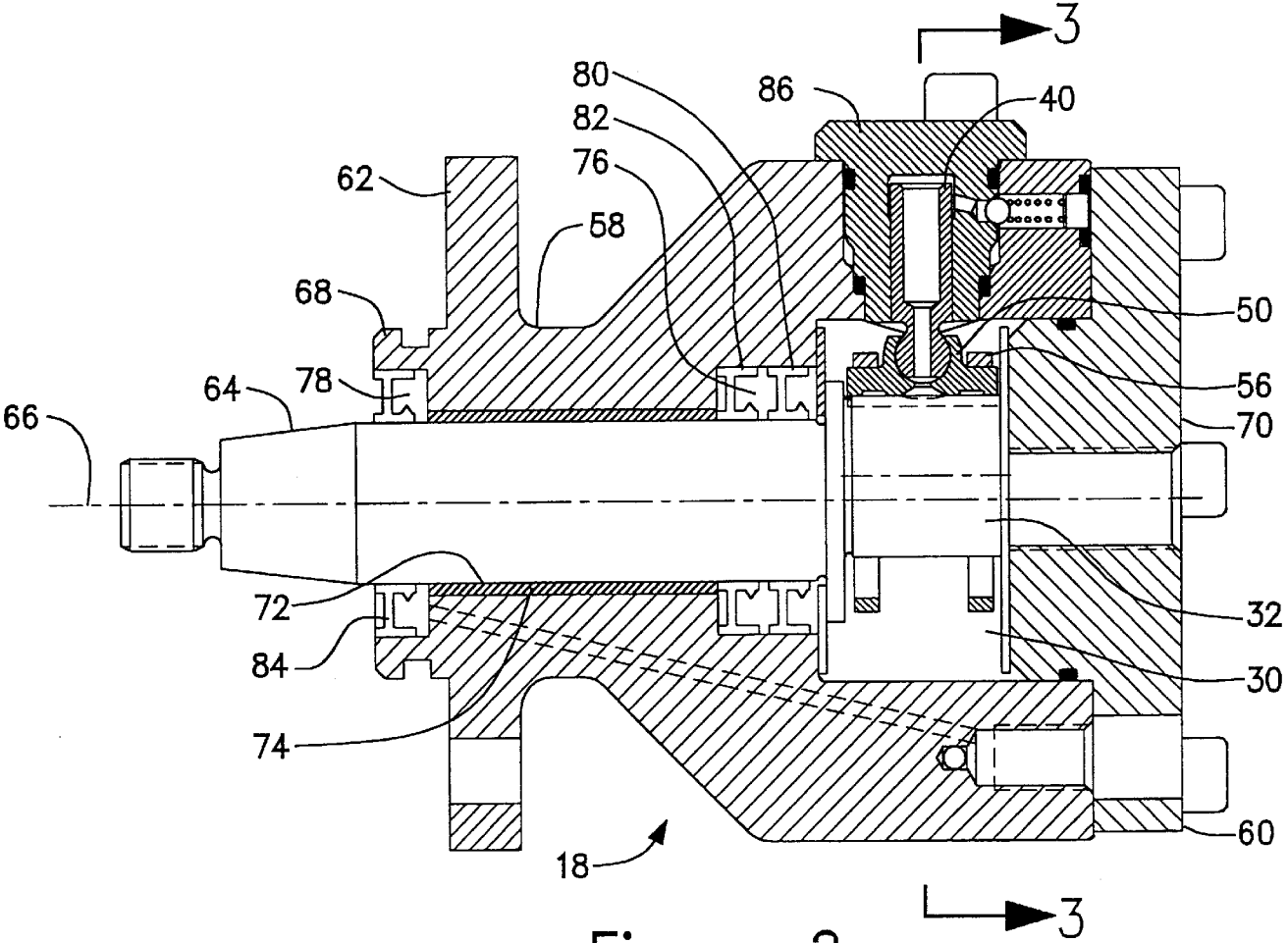
FIG. 2 is a longitudinal, partly in section and partly in phantom view of an internally driven fuel supply pump incorporating a variation of the invention.
Figure 3:
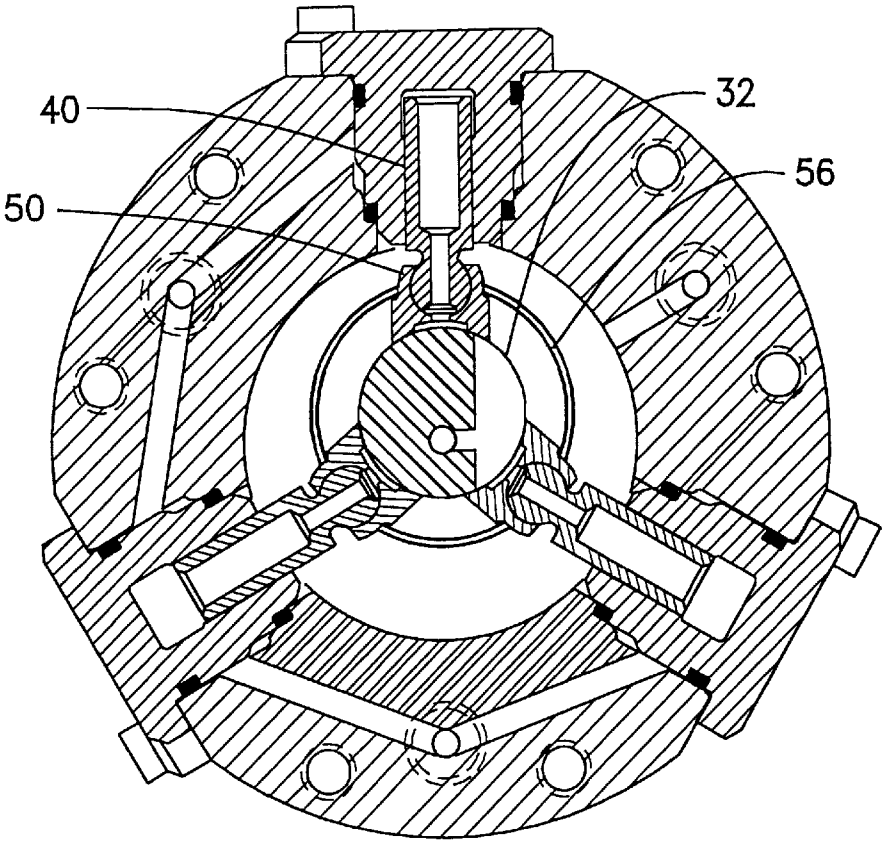
FIG. 3 is a cross-sectional view, taken along lines 3—3 of FIG. 2.
Figure 4:
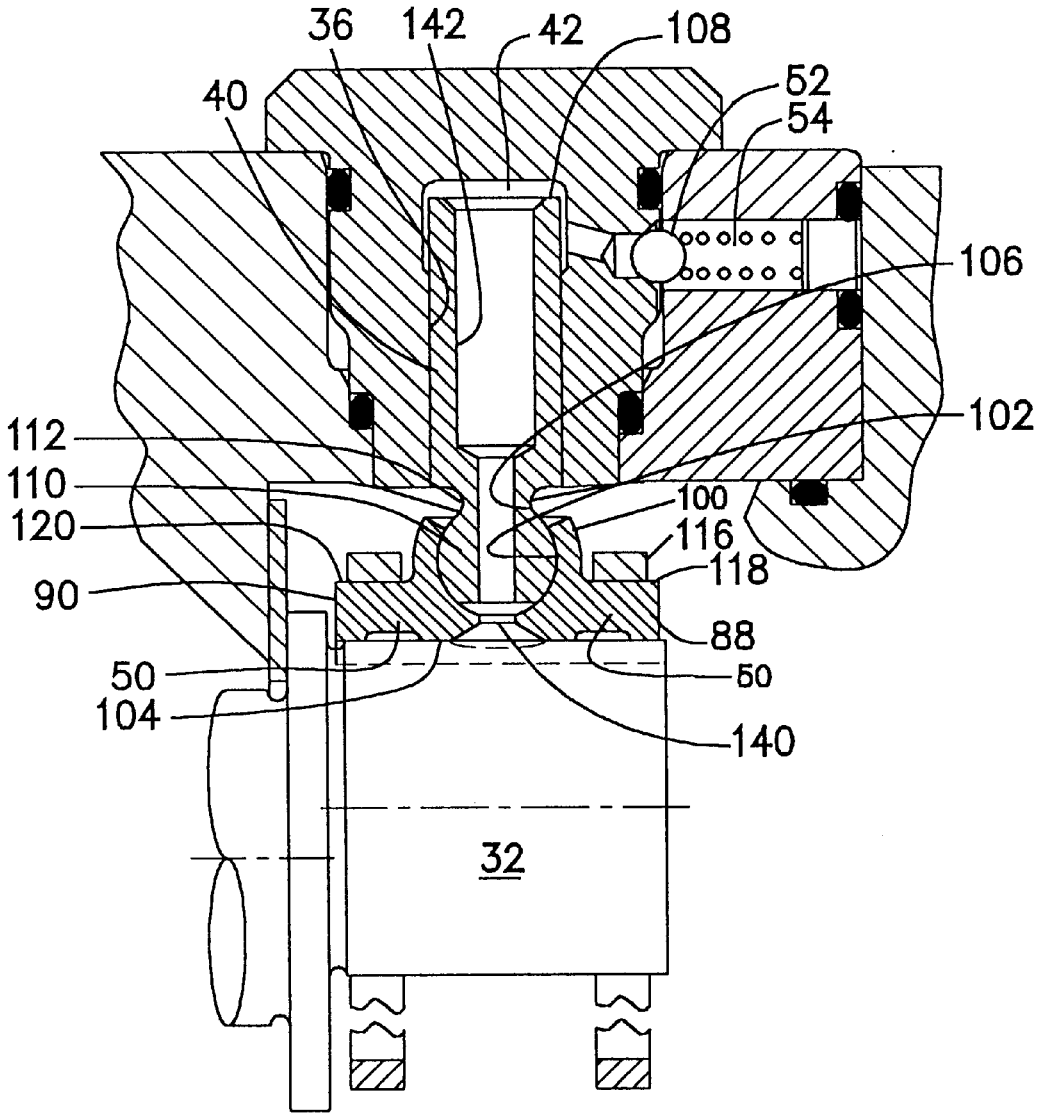
FIG. 4 is a fragmentary enlarged detailed view, partly in phantom, of the sliding shoe assembly and associated drive member shown in FIG. 2.

FIGS. 2–4 show more detail for a variation of the invention shown schematically in FIG. 1. With particular reference to FIG. 2, the fuel supply pump 18 has a body 58 and a detachable cover 60. The body at the end opposite the cover, forms a flange 62 which may be connected to the engine. The drive shaft 64 for the pump is actuated directly or indirectly by the engine, in a manner well known in this field of technology. The drive shaft 64 rotates about a longitudinal axis 66 of the pump 18. The pump housing 28 can be considered for present purposes, as constituting the combination of the pump body 58, pump cover 60 and components integral therewith, whereby a housing back end 68 and a housing front end 70 can be identified. The pump body 58 includes a drive shaft bore 72 which extends coaxially from the back end 68 of the housing to the cavity 30. The rotatable drive shaft 64 is coaxially situated in the drive shaft bore 72, journalled therein by a semi-wet bushing 74 having front and back ends. The drive shaft 64 is rigidly connected (preferably integrally) to the eccentric drive member 32, in the cavity 30. The drive shaft bore 72 includes a front seal chamber 76 interposed between and in fluid communication with the cavity 30 and the front end of the bushing 74, and a back seal chamber 78 interposed between and in fluid communication with the back end of the bushing 74 and an ambient pressure condition. First and second front seals 80, 82, are situated in the front seal chamber 76 for sealing against flow of fuel in the cavity 30, through the drive shaft bore 72. Also, a low pressure back seal 84 is situated in the back seal chamber 78, for preventing any fuel flow which might leak through the high pressure seal and through the semi-wet bushing bore to the back end of the bushing, from leaking out of the back of the housing.

While a detailed structure for the internally actuated-externally pumping fuel supply pump has been set forth for proposes of illustration, it should be understood that the invention is not limited to the described structure and can find application in other variations of internally actuated fuel supply pumps. For example, the snap in connection of the sliding shoe 50 and pumping plunger 40 may also be advantageous in fuel pump designs which individually bias the sliding shoe assembly toward contact with the drive member 32. The inventive snap in connection may also be employed in fuel pump designs which simultaneously actuate the sliding shoe assemblies.

Figure 5:
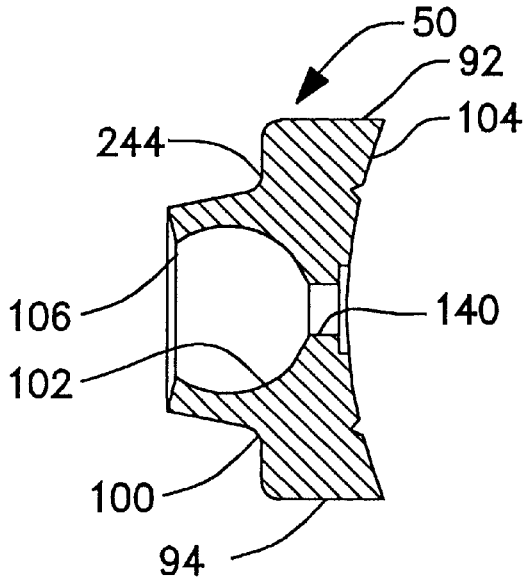
FIG. 5 is an enlarged view, partly in section, of a sliding shoe.
Figure 6:
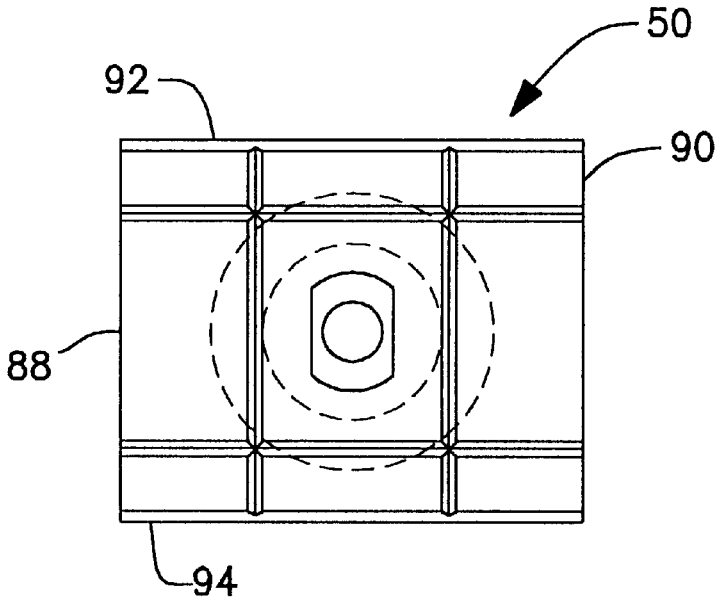
FIG. 6 is a partly in phantom, plan view of the second face of the sliding shoe of FIG. 5.

The interaction between the pumping plungers 40, sliding shoes 50, drive member 32 and cage 56 will be described in more detail. It should be understood that, typically, each plunger 40 would be disposed in a removable plunger sleeve 86 which penetrates the housing body 58. For purposes of the present description, however, it can be assumed that the plunger sleeve 86 is integral with and therefore a part of, the pump housing 28. As shown in FIGS. 5 and 6, each shoe 50 has front and back ends 88, 90, which are spaced apart in the axial direction, and two sides 92, 94 which are spaced apart in the direction of rotation of the drive member. Each shoe includes a first face 100 comprising a plunger socket 102 and a second face 104 which is adjacent the drive member 32 (see FIG. 4). The shoe socket 102 has an opening 106 to allow entry into the socket interior.

With reference in particular to FIGS. 3 and 4, each plunger 40 has a generally cylindrical body with a pumping end 108 and a driven end 110. The term "end" as used herein, should be understood as meaning that portion of the member at a terminus, or situated closer to the terminus than to the center of the member. The plunger driven end 110 is preferably formed with a substantially spherical head. The plunger head 110 may be connected to the plunger body by a narrower neck 112. The circular opening 106 flexibly expands to receive the spherical plunger driven end 110 so that the plunger head can "snap" fit into the socket 102 or the like extending from the shoe first face 100. After receiving the spherical driven end 110, the cylindrical opening 106 returns to its original dimensions, thereby closing over the spherical end 110 to pivotably capture or trap the spherical head 110 within the socket 102. Thus, the opening 106 flexes to allow the plunger head 110 to "snap" into the shoe socket 102. While the dimensional relationships between the sliding shoe opening 106 and plunger head 110 diameter as well as between the plunger head 110 diameter and sliding shoe socket 102 are important, there is, as yet, no way to establish these relationships solely by engineering design. The proper fit up of the components is a function of both engineering design considerations based on the component materials and application environment as well as refinement of that design by testing. Ideally the resulting sliding shoe 50 and plunger 40 allow ease of insertion of the plunger head 110 into the shoe socket 102; a pivotable fit between the socket 102 and head 110; minimize "backlash" and part wear; and maintain the plunger 40 trapped to the shoe 50 during use. The sliding shoe 50 and its respective plunger 40 comprise a sliding shoe assembly.

Each sliding shoe 50 is preferably comprised of a high strength engineering plastic such as, for example, PEEK available from Victrex plc. Shoes made of these materials possess an elastic limit which permits temporary flexing of the socket opening 106 to allow the plunger head 110 to pass through and thereby be captured within the socket. These materials also possess 102 sufficient strength to retain the plunger head 110 captured within the socket 102 and sufficient wear resistance to withstand the sliding contact with the drive member 32. In addition, these materials may preferably be molded to efficiently create a unitary sliding shoe 50 ready for use. The molding process allows the sliding shoe 50 to be manufactured within required tolerances, especially in the socket 102 region, without the use of secondary operations.

Figure 7:
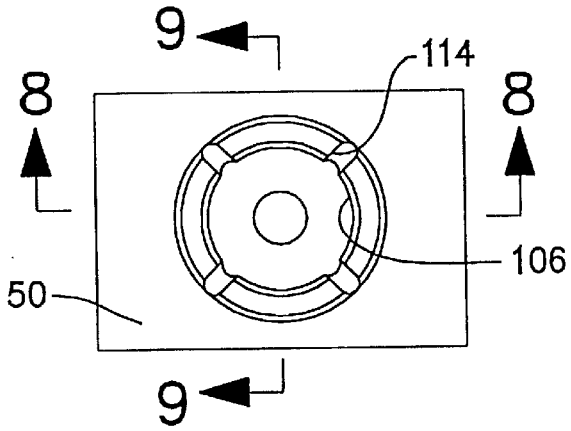
FIG. 7 is a plan view of the first face of a sliding shoe showing a socket with expansion slots.
Figure 8:
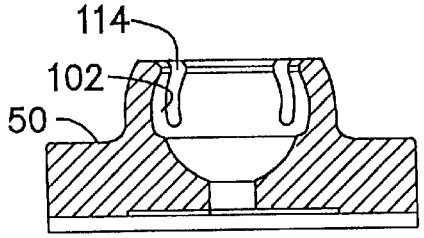
FIG. 8 is a partially cross-sectional view taken along line 8—8 of the sliding shoe of FIG. 7.
Figure 9:
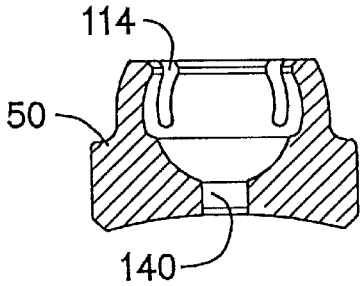
FIG. 9 is a partially cross-sectional view taken along line 9—9 of the sliding shoe of FIG. 7.

As shown in FIGS. 7–9, the sliding shoe socket may incorporate slots 114. Slotting of the sliding shoe socket increases its flexibility, thereby allowing the shoe to be made from tougher but inherently less flexible materials. Sliding shoes with slotted sockets are preferably comprised of a bearing grade plastic such as, for example, PEEK 10-10-10 available from Victrex plc or ARLON 1555 available from Greene, Tweed & Co. The sliding shoe material may also be filled with carbon fibers, graphite, Teflon and combinations thereof. Slotting of shoes made of tougher materials would provide greater pliability compared to non-slotted versions, allowing the slotted opening to accommodate a plunger head with a greater diameter. Thus, the sliding socket expansion slots 114 allow for easy installation of the plunger head 110, while still giving backlash-free retention of the plunger 40 at low frictional forces.

A substantially circular energizing ring or cage 56 is preferably wrapped around each shoe 50 (see FIG. 3), thereby connecting all the shoes 50 and their respective captured plungers 40 into a dynamically coupled system wherein movement of one shoe is related to movement in all of the other shoes. As shown in FIG. 4, the cage 56 may be comprised of two annular rings 116. Each ring 11 6 circumscribes a shoulder 118, 120 at either the respective front 88 or back 90 end of the shoe 50. The cage may also be a unitary ring incorporating apertures which cooperates with the shoe 50 in a similar manner.

As the drive member 32 rotates eccentrically, a plunger 40 is actuated through its shoe 50 toward a radially outer limit position for developing a high pressure in the pumping chamber 42. In a somewhat conventional manner, the highly pressurized fuel in the pumping chamber 42 is discharged through discharge check valve 52, into the discharge passage 54 which, in turn, fluidly communicates with the common rail. The radially outward movement of the actuated shoe 50 and plunger 40 creates a tension force on the cage 56 (shown as elements 116 in FIG. 4). This tension force is transmitted to the other sliding shoes 50 via their connection with the cage 56. As a result of the force transmitted by the cage 56, at least one shoe 50, and thereby its captured plunger 40, is pulled toward a radially inner limit position. As the plunger 40 moves toward the inner limit position a low pressure is induced in the respective pumping chamber 42.

Figure 10A:
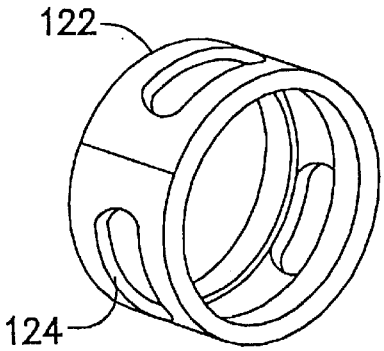
FIG. 10 is a perspective view of a variation of a cage including apertures and a sliding shoe with a seat which cooperates with the cage.
Figure 10B:
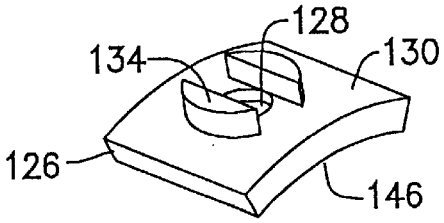
Figure 11:
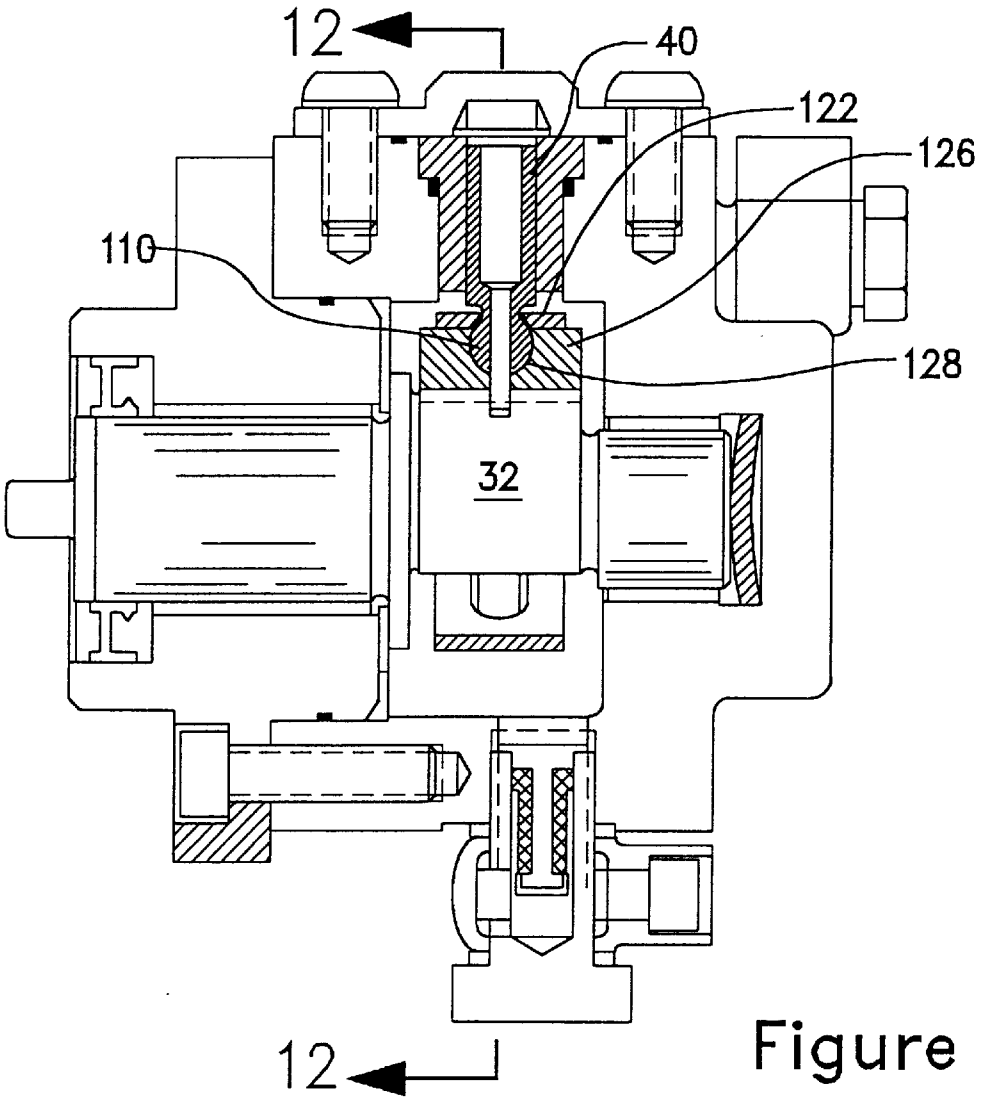
FIG. 11 is a longitudinal section through a fuel supply pump incorporating the cage and shoes of FIG. 10.
Figure 14:
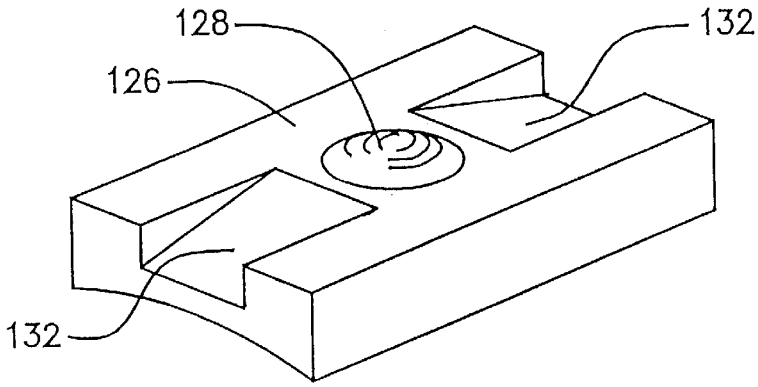
FIG. 14 is a schematic, perspective view of a sliding shoe incorporating a seat for contact with a plunger driven end and installation ramps.

While mounting of the cage 56 to the shoes 50 offers many advantages, it also imposes tension loads on the shoes 50. In another variation shown in FIGS. 10–12, the plungers are dynamically retracted by a cage 122 while the shoes 126 are maintained under either compression or in a state between no load and compression. This is done by mounting the cage 122 to the plungers 40. The cage 122 may be made of a material such as, for example, plastic or spring steel. Preferably, the cage 122 includes apertures 124. The plunger spherical head 110 "snaps" radially inwardly through a cage aperture 124 into a seat 128 of the sliding shoe first face 130. In this variation, the shoes 126 are trapped between the plunger spherical head 110 and the drive member 32. Since the shoes 126 are trapped, and further since any force is transmitted by the cage 122 directly to the plungers 40, there is no need to use a socket to capture the shoes 126 to the spherical end 110 of the plunger 40. Without a need for capture of the plunger driven end 110, the shoes 126 may be made of materials not suited for the previously described flexible snap fitting of the plunger driven end 110 into the shoe socket 102. This allows the shoes 126 to be made of materials such as ceramic or steel which are capable of transmitting higher pumping loads to the plunger 40. The shoes 126 may incorporate installation ramps 132 to aid in loading the spherical end 110 of the plunger 40 into the seat 128 during installation (see FIG. 14).

Figure 12:
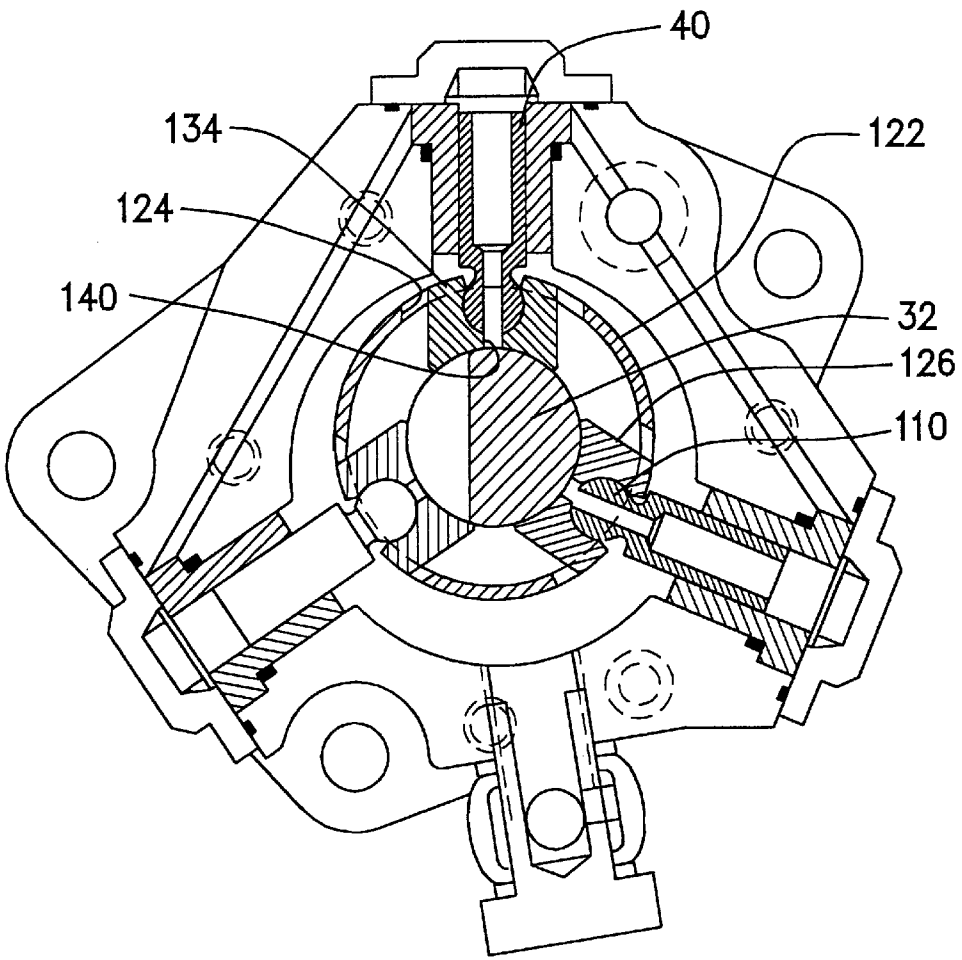
FIG. 12 is a cross-section through FIG. 11 along line 12—12 showing a different view of a fuel supply pump incorporating the cage and shoes of FIG. 10.

Alternatively, the cage 122, while captured to the plunger driven end 110, may also bear against the sliding shoe first face 130. In this manner, the shoes 126 can remain compressively loaded. The shoe first face 130 may also incorporate projections 134 which cooperate with the cage aperture 124 as shown in FIG. 12. Even with the projections 134 held within the cage apertures 124, any radial force is predominately transmitted from plunger 40 to plunger 40 by the cage 122. The shoes 126 are never in tension and see only compressive loads in this variation.

Figure 13:
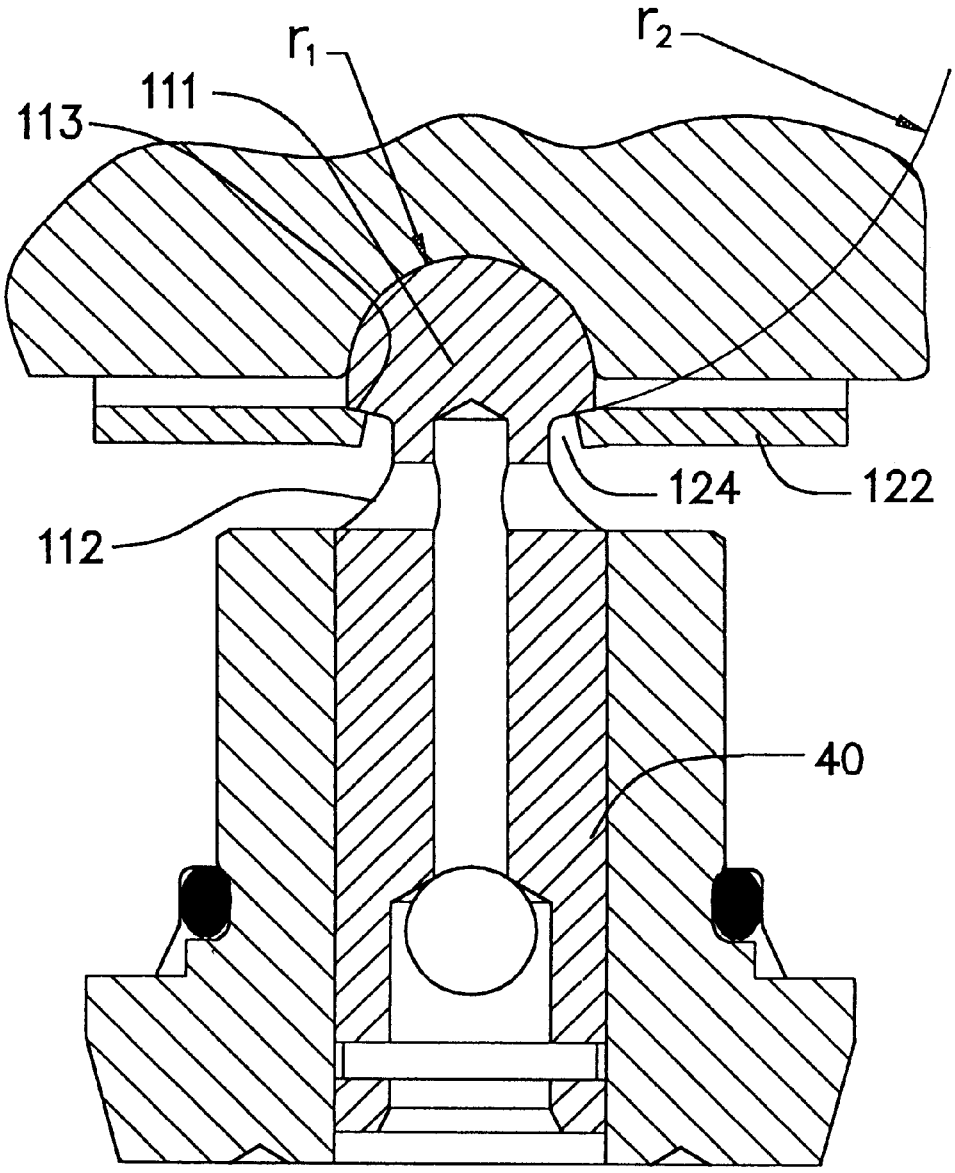
FIG. 13 is a partial cross-sectional view showing a plunger with a dual radius head captured within a cage aperture and engaged with a shoe.

The use of a material resilient enough to flex and allow the plunger head 110 to enter and be trapped by the cage aperture 124, will also limit the force the cage 122 can apply to the plunger 40 without the plunger end 110 "pulling out" of the cage aperture 124. The use of a plunger 40 with a dual radius head 111 will increase the force required to pull the plunger end 111 out of the cage aperture 124. As shown in FIG. 13, the dual radius head 111 has a smaller radius r1 at the free end to allow easy insertion of the plunger head 111 through the cage aperture 124. Adjacent the plunger neck 112 the head has a larger radius r2, creating a shoulder 113 against which the cage 122 may abut. The use of a plunger 40 with a dual radius head 111 allows the cage 122 to exert greater tension against the shoulder 113 than is possible with a single radius plunger head, as shown, for example, in FIG. 4.

Figure 15A:
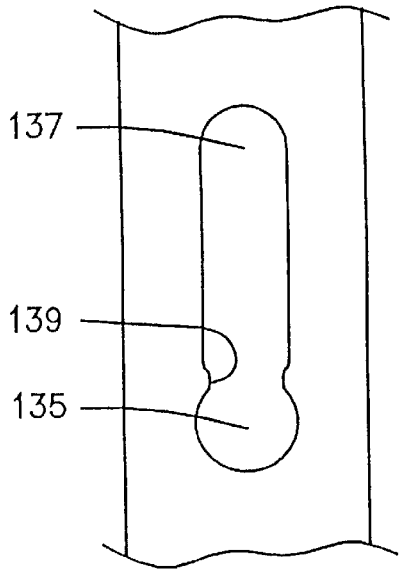
FIG. 15*a* is a top view of a portion of a cage showing an embodiment of a keyhole aperture including a narrowed region.

To allow plunger mounting to a cage 122 made of a stronger or less resilient material, such as, for example metal, the apertures can be given a slotted keyhole configuration as shown in FIG. 15*a*. The large diameter end, or installation window, 135 of the keyhole aperture or slot 136 allows the spherical end 110 of the plunger 40 to pass through. After insertion, the narrower plunger neck 112 slides into the smaller diameter end, or working window, 137 of the keyhole slot 136, capturing the plunger 40 to the cage 122. Alternatively, the spherical plunger end 110 could include opposing flats (not shown). The flats would decrease the width of the spherical end so that it could be inserted through the elongated cage aperture 124. Rotation of the plunger 40 would capture the spherical head of the plunger to the cage in a manner similar to a bayonet type mounting.

Figure 15B:
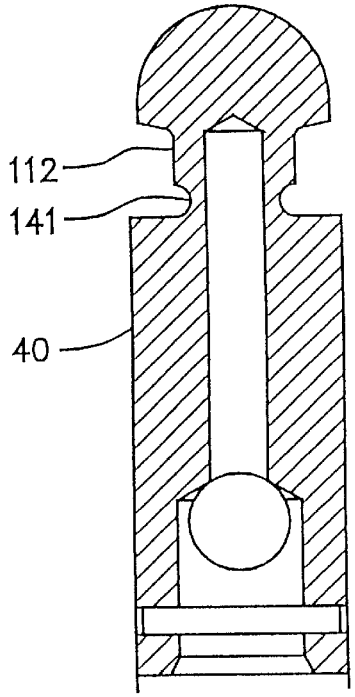
FIG. 15*b* is a cross-sectional view of a pumping plunger for cooperation with the keyhole aperture of FIG. 15*a;*

In use, rotation of the cage 122 with respect to the plunger 40 could allow the plunger head 110 to travel along the keyhole slot 136 into the larger diameter end 135 and become freed. To prevent this possibility, the keyhole slot 136 may be narrowed between the large and small diameter ends to create a plunger stop 139 as shown in FIG. 15*a*. A plunger 40 with a loading slot or groove 141, as shown in FIG. 15*b*, cooperates with the plunger stop 139 to slide past the plunger stop 139, allowing installation of the plunger neck 112 into the keyhole slot small diameter end 137. The larger plunger neck 112 is too large to slide past the plunger stop 139. After installation, the loading slot 141 is displaced out of the keyhole aperture 136 in the cage. In this condition, the plunger is captured between the sliding shoe 126 and cage 122, with the plunger neck 112 trapped within the keyhole slot smaller diameter end 137. Thus the plunger neck 112 and slot plunger stop 139 cooperate to prevent loss of the plunger head 110 from the keyhole slot 136.

Figure 16:
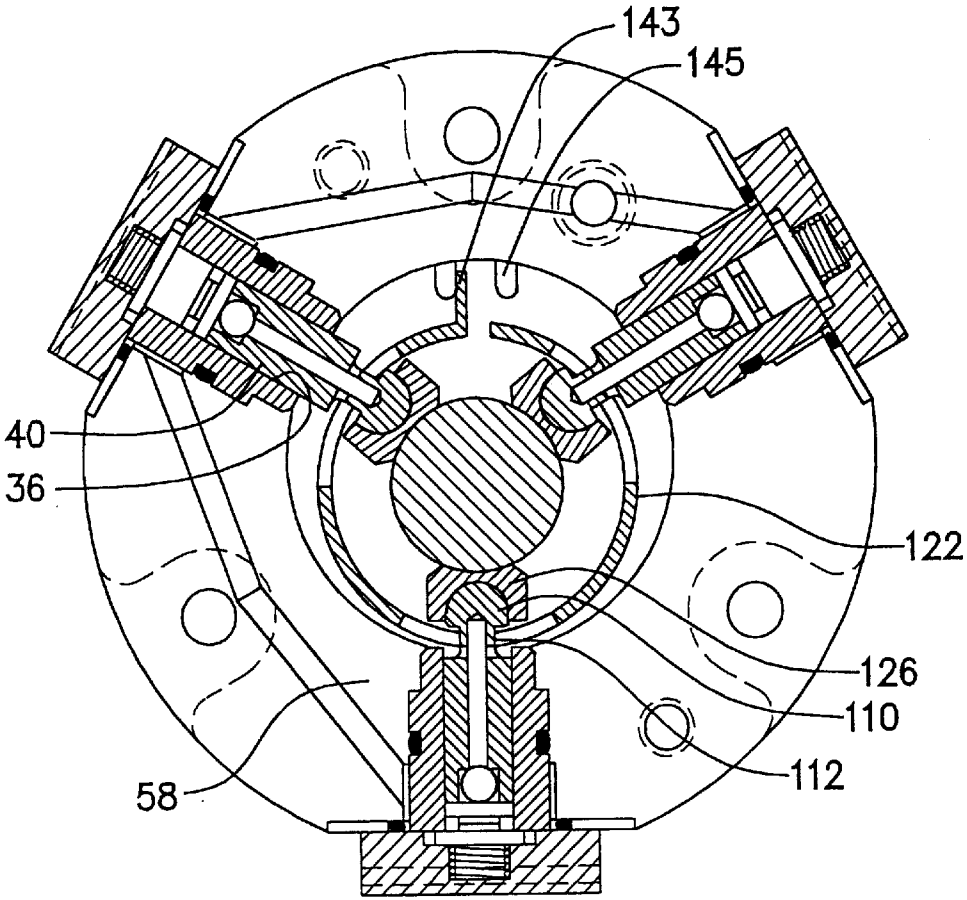
FIG. 16 is a cross-sectional view of a fuel pump with plungers having dual radius leads and a keyhole slotted cage, the cage being rotationally immobilized within the pump body.

In a different variation shown in FIG. 16, the cage 122 includes a tab 143. The wall defining the pump cavity 30 includes a slot or pair of projections 145. The tab 143 fits within the slot or pair of projections 145, rotationally fixing the cage 122 with respect to the pump body 58, while allowing movement of the cage 122 and tab 143 along the longitudinal axis of the pump cavity 30. The plunger neck 112 is within the keyhole slot smaller diameter end, trapping the plunger head 110 between the shoe 126 and the cage 122. The plunger 40 is rotationally fixed with respect to the pump body 58 by the plunger bore 36. Since both the cage 122 and plungers 40 are rotationally fixed, the plunger neck 112 cannot move from the keyhole slot smaller diameter end 137 and become freed.

Figure 17:
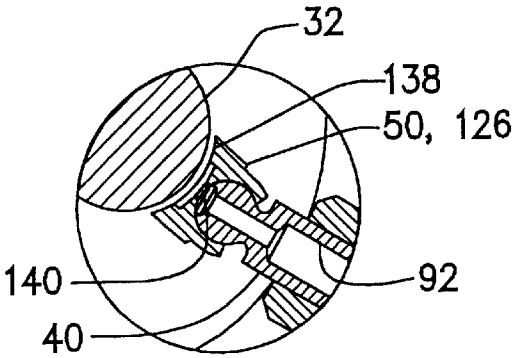
FIG. 17 is a detailed cross-sectional view of the pivotal connection between a drive member and sliding shoe assembly at a point in time when the sliding shoe has momentarily separated from the drive member.

In a noteworthy variation of the present invention, if the size and resiliency of the cage 56, 122 is appropriately selected, a controlled gap or space 138 can be produced between the shoe 50, 126 and drive member 32. The space or gap 138 is created by the cage 56, 122 holding the plunger 40 or shoe 50, 126 as the drive member 32 continues to rotate from the point at which the plunger 40 is at its radial limit position. The space or gap 138 would allow fluid entry into the frictional contact areas of the shoes 50, 126 and drive member 32. This condition is schematically represented in FIG. 17, where the gap or lift space 138 is revealed between the external profile of the drive member 32, and the arcuate second face 104, 146 of the shoe 50, 126. Preferably, the space or gap 138 produced is 0.0005 to 0.001 inches, and is maintained for up to 180° of eccentric member rotation.

In the particular pump structure shown, the simultaneous condition of low pressure created in the pumping chamber 42, shown in FIG. 4, during radially inward movement of the plunger 40 due to the "no backlash" connection of the plunger head 110 and shoe socket 102, and the exposure of the shoe bore 140 to this low pressure via passage 142, further produces a charging flow into the gap or lift space 138 of FIG. 17. Thus the "no backlash" connection of the plunger 40 to the shoe 50 and the dynamic mechanical return of the cage 56 combine to increase intake efficiency of the pumping chamber 42 and lubricate the frictional contact area of the drive member 32 and shoe second faces 104, 146.

Figure 18A:
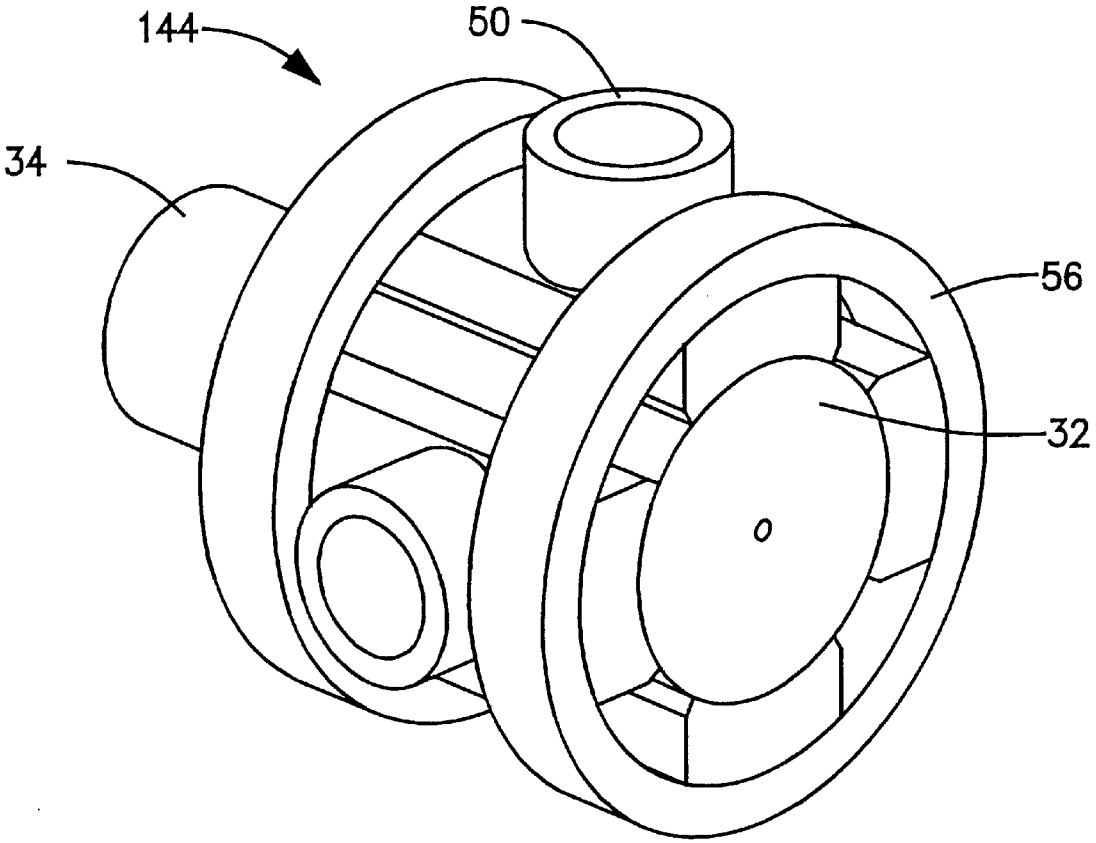
FIG. 18*a* is a perspective view of a preassembled fuel pump drive sub-assembly illustrating the shaft and mounted drive member with the sliding shoes held adjacent the drive member by a cage comprising two, spaced, resilient annular rings.
Figure 18B:
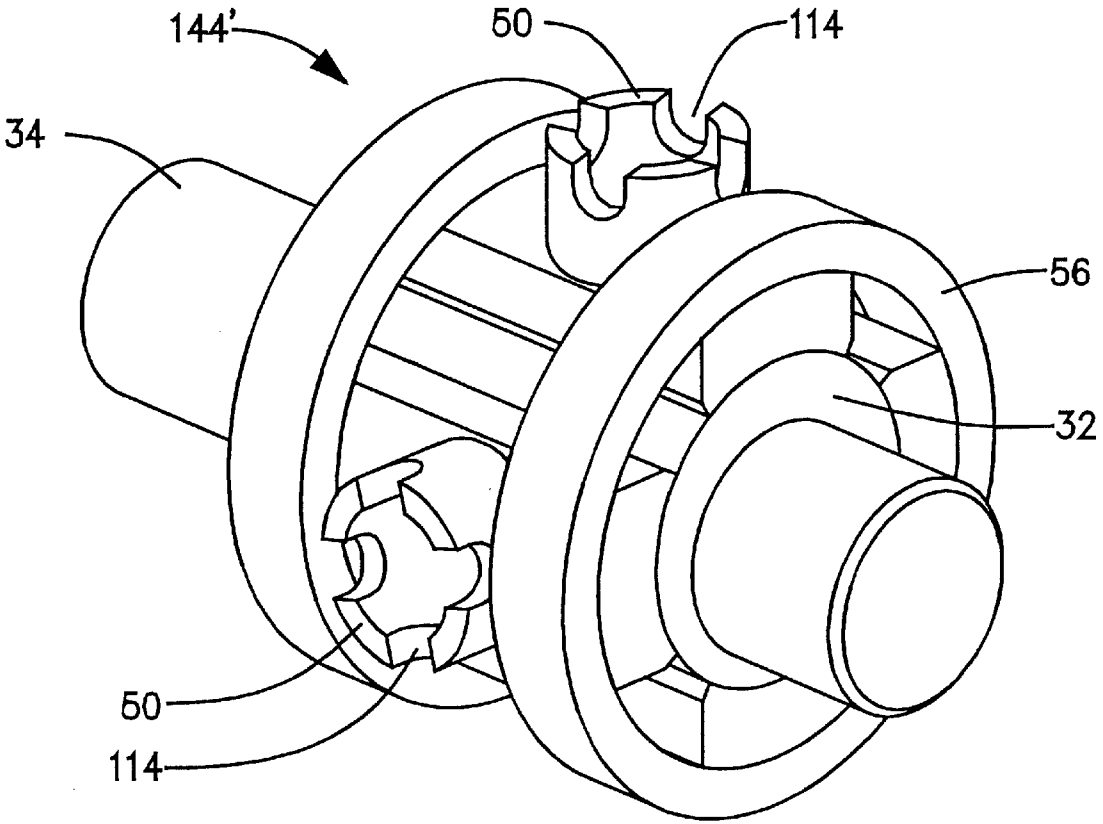
FIG. 18*b* is a variation of FIG. 18*a* wherein the sub-assembly includes a rigid metal case and slotted shoes.
Figure 22:
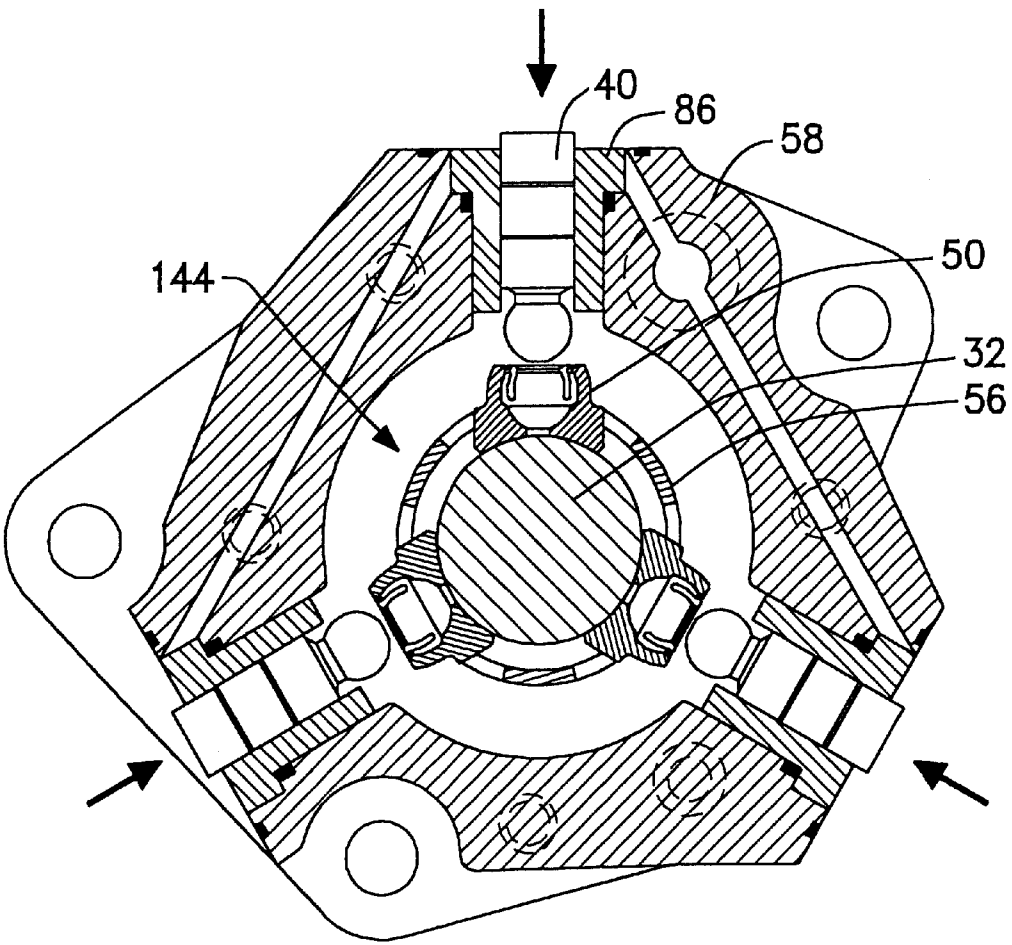
FIG. 22 is a schematic illustration of pumping plunger installation into a fuel pump just prior to the snapping engagement of the plunger head with the sliding shoe seat.

In traditional fuel pumps, each plunger is biased by its own spring, so the reciprocating parts must be assembled individually. It can be appreciated that given the small size and extremely tight clearances of high pressure fuel pumps, this assembly process is necessarily complicated and slow. The use of the inventive sliding shoes 50, cage 56 and plungers 40 allows the high pressure fuel pump to be assembled in a less complicated and quicker manner than traditional fuel pumps. With reference to FIG. 22, using the inventive components, a sub-assembly 144 comprising a drive shaft 34 with an eccentrically mounted drive member 32 can be provided external to the pump body. The requisite number of sliding shoes 50 can be positioned adjacent the drive member 32 and held in place by the cage 56. An example of this sub-assembly 144 is also shown in FIG. 18*a*. A different variation of the sub-assembly 144' incorporating a higher strength metal cage 56 and sliding shoes 50 with slots 114 is shown in FIG. 18*b*. It should be appreciated that the assembling of these sub-assemblies 144, 144' can be done mechanically or robotically and also that each sliding shoe 50 can be pre-oriented angularly on the drive member 32. The sub-assembly 144, 144' is then inserted into a pump body 58. The angular pre-orientation of the sliding shoes 50 during manufacture of the sub-assembly 144, 144' allows the socket 102 of each sliding shoe 50 to be aligned with a bore axis of each plunger bore 36 upon insertion of the sub-assembly 144, 144' into the pump body 58. Pumping plungers 40 are then inserted through each bore 36. In shoe retained variations, the spherical head 110 is pushed through the socket opening 106 and thereby snaps into and is captured within the sliding shoe socket 102. In fuel pumps which utilize plunger sleeves 86 fitting within the pump body bores 36, a pumping plunger 40 and plunger sleeve 86 sub-assembly 148 is inserted in a similar fashion into the pump body 58 so that the plunger head 110 snaps into, and is captured by, the sliding shoe socket 102.

In variations where the plunger head 110, 111 is retained by the cage 122, a similar assembly method is used. A drive sub-assembly (not shown) comprising a shaft 34 with an eccentrically mounted drive member 32 and sliding shoes 126 held adjacent to the drive member 32 by the cage 122 is assembled and inserted into the fuel pump body 58. Pumping plungers 40, either individually or incorporated within a plunger sleeve 86, are inserted into a bore 36 of the fuel pump body 58. As the plunger 40 or plunger/sleeve sub-assembly 148 is inserted into the bore, the head 110, 111 contacts, and snaps through, an aperture 124 in the cage 122 coming into engagement with a sliding shoe seat 128. The inventive snap in connection may also enhance fuel pump assembly methods wherein the shoe is individually placed in the fuel pump body 58 adjacent the drive member 32 and the plunger 40 is inserted through the bore to snap into the shoe or where the shoe and plunger are preassembled.

Figure 19:
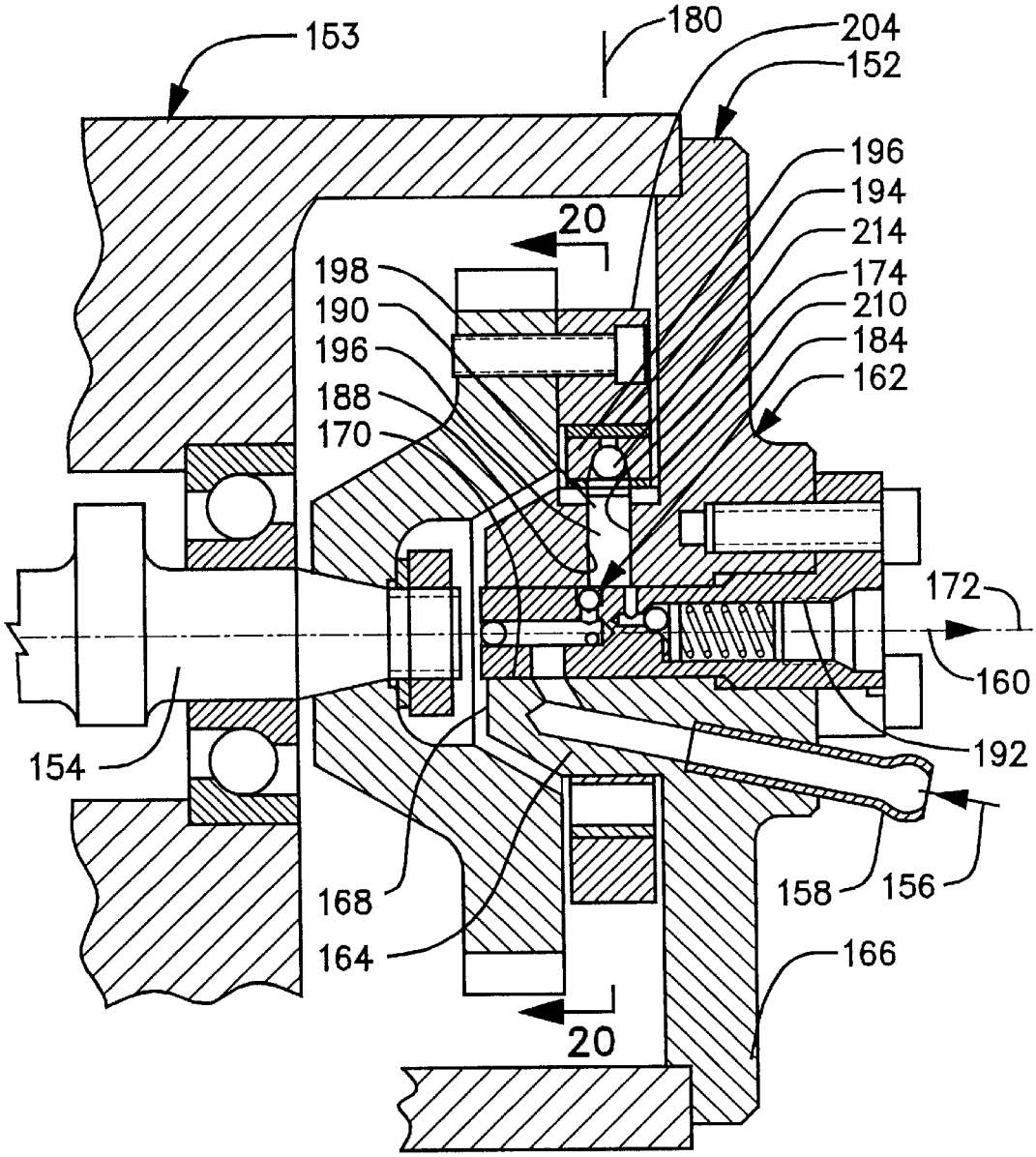
FIG. 19 is a longitudinal section view through an externally driven-internally pumping fuel supply pump showing a different variation of the invention.
Figure 20:
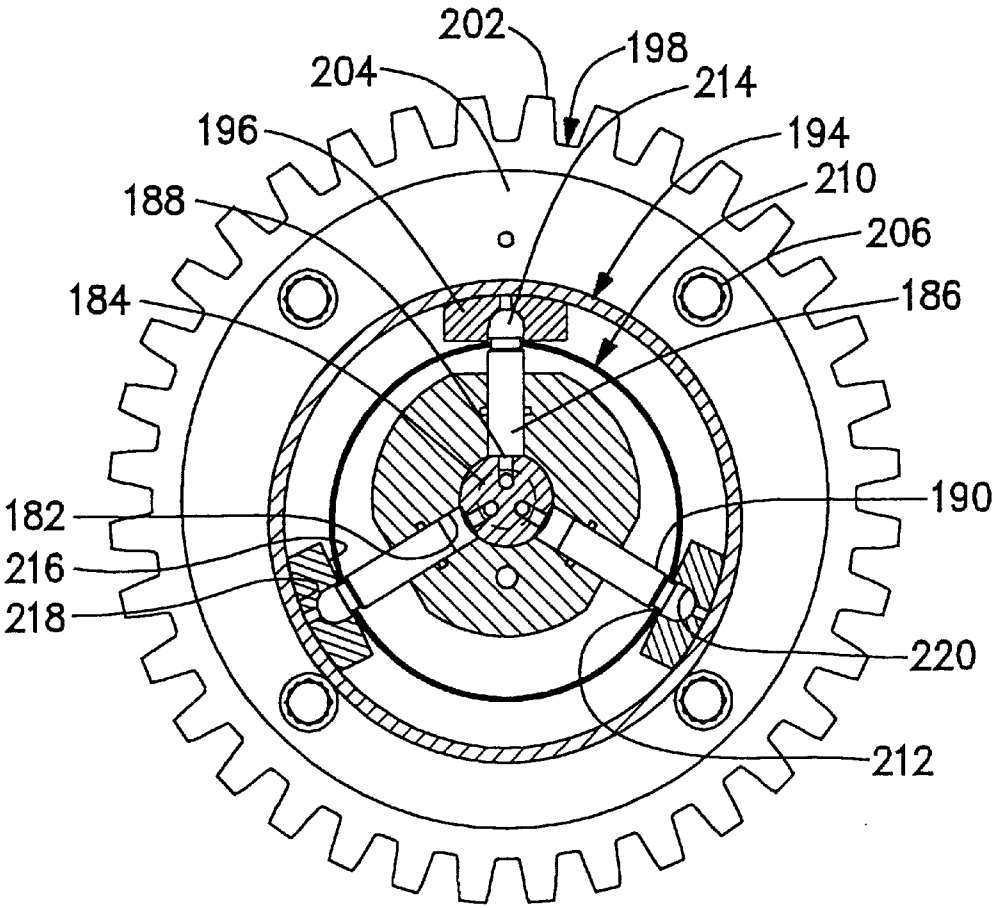
FIG. 20 is a partial cross-sectional view taken along line 20—20 of FIG. 19.

FIGS. 19–20 show a different embodiment of a high pressure pump incorporating the inventive snap in connection between pumping plungers and sliding shoes. This embodiment comprises an externally driven-internally pumping supply pump 152 as part of the fuel injection system of FIG. 1. In this embodiment, the pump 152 may be mounted to an engine 153 and rotatably driven directly by the cam shaft 154 which operates the intake and exhaust valves on the engine. A source of fuel, such as a fuel pump 14 from the fuel tank 12, supplies liquid fuel in the direction of arrow 156 at low pressure to the inlet 158 of the pump 152. The high pressure pump 152 delivers fuel at an elevated pressure in the direction of arrow 160, to the accumulator 24 or injectors 26. It should be understood, however, that the pump according to the invention can be connected to a different source of rotational drive.

The pump 152 has a body 162 with an elongated hub portion 164 extending between arbitrary front and back ends 166, 168. The hub 164 has a central bore 170 extending from front to back, along a central axis 172. The hub 164 has a plurality of plunger bores 174 spaced uniformly about the axis 172 intermediate the front 166 and back 168 ends of the body 162, and extending radially through the hub portion 164 to the central bore 170. The center lines or axes 178 of the plunger bores 174 lie on a plane which, for convenience, will be referred to as the pumping plane 180.

The radially inner ends 182 of the plunger bores 174 are confronted by the valve housing 184. A plunger body 186 having radially inner and outer ends 188, 190, is situated in each of the plunger bores 174, for reciprocal movement. The radial length of each bore 174 will depend on the desired plunger stroke which, along with the bore diameter, defines the maximum volume of fuel which could be forced into the discharge chamber 192 at high pressure upon the plunger 186 reaching its radially inner limit position.

The plungers 186 are actuated by a rigid actuating ring or drive member 194 which surrounds the plungers 186 and is mounted for eccentric rotation about the central axis 172. The eccentricity drives each plunger 186 radially inwardly in sequence, preferably via sliding shoes 196. Each sliding shoe 196 and its respective plunger 186 comprise a sliding shoe assembly.

The support structure 198 for the actuating ring or drive member 194 in the described pump preferably takes the form of the cam gear that is already present for taking off power from the engine crank shaft to rotate the valve cam shaft 154. The external teeth 202 engage a belt or chain (not shown) which in turn engages teeth on a gear driven by the crank shaft (not shown). A circular collar 204 is rigidly connected via bolts 206 or the like, to the front face of the cam gear 198 in coaxial relation to the cam gear. The actuating ring 194 is rigidly mounted within the collar 204, eccentrically relative to the cam gear axis, so as to bear on the sliding shoes 196.

While a detailed structure for the externally actuated-internally pumping fuel supply pump has been set forth for purposes of illustration, it should be understood that the invention is not limited to the described structure and can find application in other variations of externally actuated fuel supply pumps. For example, the snap in connection of the shoe assembly may also be advantageous in fuel pump designs which individually bias the shoe assembly toward contact with the drive member 194. The inventive snap in connection may also be used in fuel pumps wherein the plungers are simultaneously driven toward a filling position by a multiply lobed external cam.

Radially inward movement of each plunger 186 delivers fuel at a relatively high pressure from each plunger sleeve 174 to the discharge chamber 192. Radially outward movement of each plunger 186 draws fuel at a relatively lower pressure into each plunger sleeve 174. As the actuating ring 194 is rotated, it forces the outer end 190 of the plunger 186, by way of the sliding shoes 196, radially inward. To assure that each plunger 186 moves toward its radially outward limit position, a cage 210 is provided. As previously discussed, the cage 210 dynamically transmits the radially inwardly motion of the actuated plunger 186 to the remaining plungers 186, thereby moving at least one plunger 186 radially outwardly.

Preferably, as shown in FIGS. 19 and 20, the cage 210 is in the form of a ring which circumscribes the valve housing 184 on the pumping plane 180. The cage 210 is mounted to the plungers 186 adjacent their radially outer ends 190. The mounting may be as previously described by way of apertures 212 included within the cage 210 through which the plunger head 214 at its radially outer end 190 snaps through and is captured. The plunger head may also incorporate the previously described dual radius design. The mounting may alternatively be accomplished by use of the previously described keyhole slots (not shown) in the cage. The cage 210 may be made from, as an example, steel or VESPEL (available from the Dupont Company). The sliding shoe second face 218 engages the drive member 194 and the sliding shoe first face 216 engages the plunger driven head 214. Thus, the sliding shoe 196 is trapped between the drive member 194 and plunger driven end 190. Therefore, the shoe first face 216 need not capture the plunger head 214 and may comprise a seat 220. However, the use of sliding shoes including a socket which snap fits over and captures the plunger driven end would allow the fuel pump, including sliding shoes, to be conveniently assembled and stored as a sub-assembly prior to use.

By pivotably capturing the plunger 186 within the cage aperture 212, the cage 210 may also bear against the radially inner first face 216 of the sliding shoe 196. In this variation, the motion of both the actuated shoe 196 and plunger 186 is dynamically transmitted to all of the other shoes 196 and their respective plungers 186.

Figure 21:
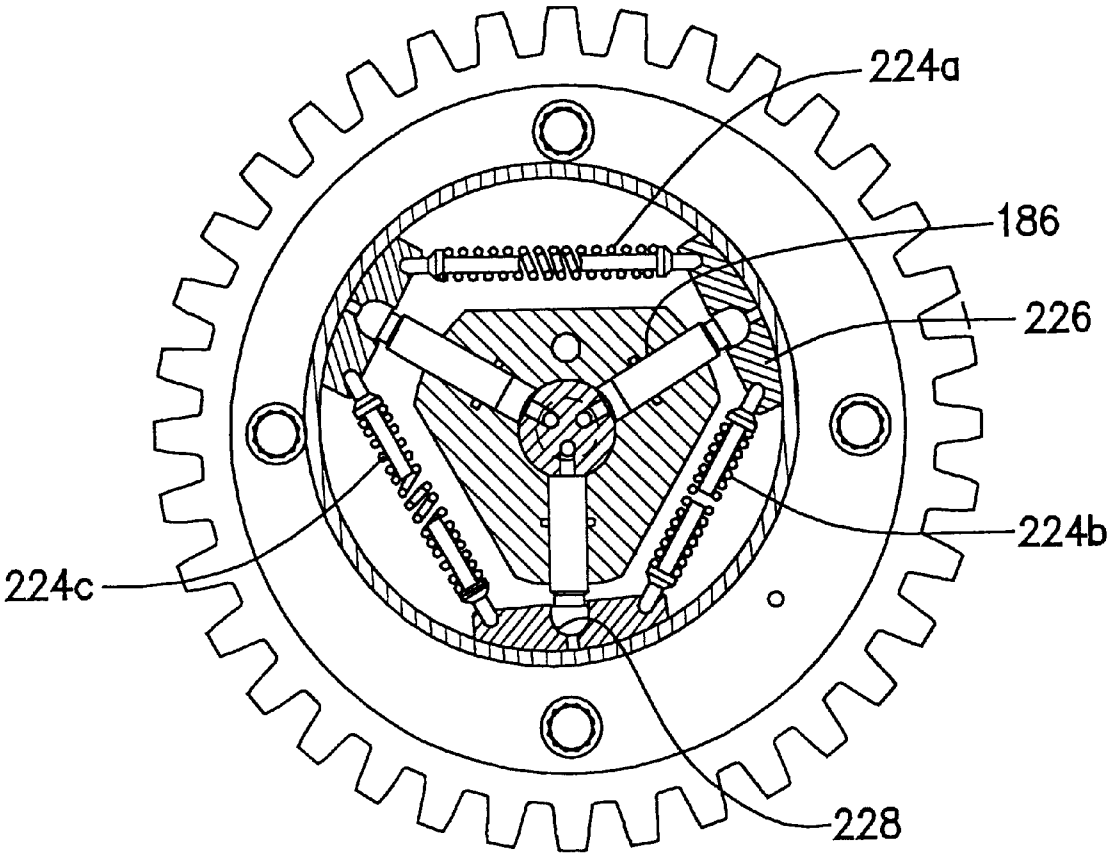
FIG. 21 is a view similar to FIG. 20 showing a segmented cage dynamically connecting the sliding shoe assemblies.

In another variation shown in FIG. 21, struts (224*a*–*c*) are mounted to all of the sliding shoes 226 to form a cage. Thus movement of one shoe 226 is transmitted to all of the other shoes 226. In this variation, the cage need not be a unitary member, the struts 224*a–c*, link each shoe 226 to its adjacent shoes 226. The struts 224*a–c* are capable of various configurations while retaining the ability to transfer motion from one shoe 226 to the other shoes 226. By capturing each plunger 186 to a socket 228 on its respective shoe 226, the movement of each shoe 226 is transmitted to its respective plunger 186. Thus, the segmented cage, 224*a–c,* would couple all of the shoes 226, and thereby their respective captured plungers 186, into a single dynamically connected unit wherein movement in one shoe is linked to movement in all of the plungers. It would also be possible to use a unitary cage (not shown) to dynamically link each sliding shoe 226 and thereby its captured plunger 186.

As with the previous embodiment, by appropriately selecting the size and resiliency of the cage, a controlled gap or space can be produced between the shoe sliding surface and drive member as the drive member rotates. The space or gap would allow lubricant entry into this frictional contact area, decreasing friction and increasing load carrying capacity. Preferably, the space or gap produced is 0.0005 to 0.001 inches, and is maintained for up to 180° of eccentric member rotation.

As will be apparent to persons skilled in the art, various modifications and adaptations of the structure above described will become readily apparent without departure from the spirit and scope of the invention, the scope of which is defined in the appended claims.

What is claimed:

1. A reciprocating sliding shoe assembly for a high pressure fuel supply pump, comprising:

a pumping plunger with a driven end; and a sliding shoe with two opposing faces, a first said face including a socket having an aperture, said socket aperture elastically expanding to snap over said plunger driven end, wherein said driven end is captured within said socket.

2. The sliding shoe assembly of claim 1 wherein said sliding shoe is comprised of a plastic material.

3. A high pressure fuel supply pump, comprising:

a pump body having a central axis;

a rotatable drive shaft coaxially aligned with the central axis;

a drive member connected to the drive shaft for rotation therewith;

a plurality of spaced bores arrayed in the pump body, each having a bore axis oriented perpendicularly relative to the central axis;

a plurality of pumping plungers situated respectively in the array of bores for reciprocation therein along the respective bore axes thereby defining a pumping chamber in each plunger bore, each said plunger having a pumping end and a driven end including a head;

a plurality of sliding shoes, each having a first face and an opposing second face adjacent the drive member, one said sliding shoe and one said plunger comprising a sliding shoe assembly;

means for biasing each said sliding shoe assembly toward said drive member;

wherein said drive member, said shoes and said means for biasing comprise a drive sub-assembly and said drive sub-assembly is adapted to snap fit over and retain each said plunger head;

a low pressure fuel supply for supplying a fuel at a relatively low pressure to each pumping chamber; and a high pressure fuel discharge for delivering said fuel at a relatively high pressure from each pumping chamber.

4. The pump of claim 3 wherein said shoe is comprised of a plastic material.

5. The pump of claim 3 wherein each said shoe first face includes a socket, each said socket being adapted to snap-fit over and retain a respective plunger head.

6. The pump of claim 5 wherein:

each said plunger head has a substantially spherical shape with a first maximum outside diameter;

each said sliding shoe socket includes a wall defining a substantially spherical internal cavity with a second maximum internal diameter, said socket also defining a substantially circular opening with a third internal diameter;

wherein said opening third diameter is smaller than said cavity second diameter and said head first diameter is greater than said opening third diameter but less than said cavity second diameter.

7. The pump of claim 6 wherein at least one aperture is defined in a said socket wall.

8. The pump of claim 7 wherein said aperture defines a slot radially extending from said socket opening.

9. The pump of claim 6 wherein an aperture connects said socket cavity with said shoe second face.

10. The pump of claim 6, wherein each said plunger head is pivotally retained within said respective socket.

11. The pump of claim 3 wherein said means for biasing comprises a cage contiguous with each said shoe.

12. The pump of claim 11 wherein said cage and said shoes are integral.

13. The pump of claim 11 wherein for part of said drive member rotation, at least one said shoe second face is spaced from said drive member.

14. The pump of claim 3, including a plurality of plunger sleeves each having a sleeve axis, each said sleeve disposed in one said pump body bore, wherein each said plunger is situated in one said sleeve for reciprocation therein along the respective sleeve axis thereby defining a pumping chamber in each sleeve bore.

15. The pump of claim 11, wherein:

said cage defines a plurality of apertures;

each said shoe first face includes a seat; and each said cage aperture is adapted to snap over and retain a respective plunger head, wherein said plunger head engages said sliding shoe seat.

16. The pump of claim 15, wherein:

each said plunger head has a substantially spherical shape with a first maximum outside diameter;

each said sliding shoe seat includes a wall defining a partially spherical internal cavity with a second maximum internal diameter, said wall also defining a substantially circular opening with a third internal diameter equal to said cavity second diameter; and said head first diameter is less than said seat second diameter.

17. The pump of claim 16, wherein each said cage aperture defines a minimum width which is less than said plunger head first diameter.

18. The pump of claim 16 wherein said cage aperture comprises a keyhole aperture defining a large diameter end and a small diameter end; and said plunger head first diameter is smaller than said keyhole aperture large diameter and greater than said keyhole aperture small diameter.

19. The pump of claim 18 wherein said cage is rotationally immobilized by said pump body.

20. The pump of claim 18 wherein:

said keyhole aperture includes a plunger stop disposed between said large and small ends; and said plunger includes a neck connecting said plunger head to said plunger driven end, said neck including a loading groove, said loading groove cooperating with said plunger stop to allow capturing said plunger neck within said keyhole aperture small diameter end.

21. The pump of claim 15 wherein each shoe first face includes a projection which fits within one said cage aperture.

22. The pump of claim 15 wherein each shoe first face includes a loading ramp.

23. The pump of claim 15, wherein a neck connects said plunger head to said plunger driven end and said plunger head defines a larger radius adjacent said neck and a smaller radius at a free end.

24. A method for assembling a high pressure fuel supply pump, comprising:

providing a pump body having a central axis and a plurality of spaced bores situated in the pump body perpendicularly relative to the central axis, each bore including a bore axis intersecting the central axis;

installing a drive member into said pump body;

placing a plurality of sliding shoes with opposing first and second faces within said pump body, wherein said second face of each shoe is adjacent said drive member;

aligning each said sliding shoe with one said pump body bore axis;

selecting a plurality of plungers each having a pumping end and an opposing driven end including a head;

installing each said plunger in one said pump body bore; and capturing each said plunger head by snaps into a said first face of one said sliding shoe.

25. A method for assembling a high pressure fuel supply pump with a drive sub-assembly, comprising:

providing a pump body having a central axis and a plurality of spaced bores situated in the pump body perpendicularly relative to the central axis, each bore including a bore axis intersecting the central axis;

configuring external to said pump body a drive sub-assembly comprising a drive member with a longitudinal axis and a plurality of sliding shoes each having a first face and an opposing second face adjacent said drive member;

retaining each said shoe second face adjacent said drive member;

installing said drive sub-assembly into said pump body wherein said drive member axis is aligned with said central axis;

aligning each said sliding shoe with one said pump body bore axis;

selecting a plurality of plungers each having a pumping end and an opposing driven end including a head;

installing each said plunger in one said pump body bore; and engaging each said plunger head and said drive sub-assembly.

26. The method of claim 25 wherein the drive sub-assembly includes a cage contiguous with each sliding shoe.

27. The method of claim 26, wherein:

each said plunger head has a substantially spherical shape with a first maximum outside diameter;

each said sliding shoe first face comprises a socket including a wall defining a substantially spherical internal cavity with a second maximum internal diameter, said socket also defining a substantially circular opening with a third internal diameter, said opening third diameter being smaller than said cavity second diameter;

wherein said head first diameter is greater than said opening third diameter but less than said cavity second diameter; and the step of engaging comprises the steps of moving each said head through one said socket opening and positioning said head within said socket cavity.

28. The method of claim 25 including:

providing a plunger sub-assembly comprising a plunger sleeve having a sleeve bore with a respective sleeve axis and a plunger situated in said sleeve bore for reciprocation therein along the respective sleeve axis, thereby defining a pumping chamber in each sleeve bore; and installing said plunger sub-assembly in one said pump body bore.

29. A method for assembling a high pressure fuel supply pump body sub-assembly, comprising:

providing a pump body having a central axis and a plurality of spaced bores situated in the pump body lying in a substantially common plane oriented perpendicularly relative to the central axis, each bore including a bore axis intersecting the central axis;

selecting a plurality of plungers each having a pumping end and an opposite driven end including a head;

installing each said plunger pumping end in one said pump body bore;

selecting a plurality of sliding shoes each having two opposing faces; and engaging each said plunger head with a second said sliding shoe face to create a pump body sub-assembly.

30. The method of claim 29, wherein:

each said plunger head has a substantially spherical shape with a first maximum outside diameter;

each said sliding shoe first face comprises a seat including a wall defining a partially spherical internal cavity with a second maximum internal diameter, said wall also defining a substantially circular opening with a third internal diameter, said opening third diameter being equal to said cavity second diameter and said head first diameter being less than said seat second diameter; and the step of engaging comprises positioning said plunger spherical head within said seat cavity.

31. The method of claim 30, including providing a cage with an aperture having a minimum width which is less than said plunger head first diameter; and the step of engaging includes snapping said plunger head through said cage aperture.

* * * * *